US005564621A

United States Patent [19]

Writt

[11] Patent Number: 5,564,621

[45] Date of Patent: Oct. 15, 1996

[54] DRINK CARTON FOR THE ELDERLY AND INFIRM

[75] Inventor: Michael E. Writt, Indianapolis, Ind.

[73] Assignee: M & D Sales Company, Inc., Indianapolis, Ind.

[21] Appl. No.: 489,825

[22] Filed: Jun. 13, 1995

Related U.S. Application Data

[63] Continuation of Ser. No. 137,283, Oct. 14, 1993, abandoned.

[51] Int. Cl.[6] ..... B65D 5/42

[52] U.S. Cl. ..... 229/103.1; 229/125.42

[58] Field of Search ..... 229/103.1, 125.42, 229/137, 213, 214, 249; 220/705, 710; 215/388, 389; 206/459.5

[56] References Cited

U.S. PATENT DOCUMENTS

| | | | |
|---|---|---|---|
| 1,243,033 | 10/1917 | Beatty | 229/103.1 |
| 2,324,807 | 7/1943 | Wentz | 229/103.1 |
| 2,996,233 | 8/1961 | Craig et al. | 229/125.42 |
| 3,596,829 | 8/1971 | Gardner | 229/103.1 |
| 4,216,801 | 8/1980 | Aykanian | 229/103.1 |
| 4,429,828 | 2/1984 | Farber | 229/103.1 |
| 4,591,091 | 5/1986 | Wise | 229/103.1 |
| 4,974,772 | 12/1990 | Spurrell et al. | 229/125.42 |

FOREIGN PATENT DOCUMENTS

| | | | |
|---|---|---|---|
| 139799 | 5/1985 | European Pat. Off. | 229/103.1 |
| 2659275 | 7/1978 | Germany | 229/125.42 |
| 1017956 | 1/1966 | United Kingdom | 229/125.42 |

*Primary Examiner*—Gary E. Elkins

*Attorney, Agent, or Firm*—Woodard, Emhardt, Naughton, Moriarty & McNett

[57] ABSTRACT

A modified gabled drink carton is disclosed which makes it easier for the elderly and infirm patient to open and use the cation and to thereby drink nutritional liquid contained therein. The disclosed carton includes, in addition to the gabled pour spout on a standard gabled drink cation, a straw port which is located under the gable opposite thereto. Identifying markings distinguish the pour-spout gable and the opposing straw-pod gable, and thereby help the user to locate the end which has the type of opening that is desired to be used.

4 Claims, 3 Drawing Sheets

DRINK CARTON FOR THE ELDERLY AND INFIRM

This application is a continuation of application Ser. No. 08/137,283, filed Oct. 14, 1993, now abandoned.

BACKGROUND OF THE INVENTION

This invention relates to the care of the elderly and infirm. In particular, this invention relates to the providing of packaging for nutritional drink products, and to such packaging which helps the elderly or infirm patient to be able to open the packaging and to drink therefrom.

In the institutional food supply industry, nutritional drinks have commonly been packaged in the standard gabled drink carton, which has been been in use for many years. This standard cation is opened for usage by separating one gabled end and folding it out into a pour spout. The pour spout opening is then used to either drink directly from the cation, use a straw for drinking, or pour the liquid into a glass or cup for drinking. Each of these options includes the step of first opening the one gabled end, that is configured for being so opened, into a spout. This ordinarily simple step, though, can be sometimes difficult for an elderly person or infirm patient to accomplish.

In order to be opened, the standard gabled drink carton must be stably held while the spout gable is evenly pulled apart and then opened into the spout. The elderly, who are commonly inflicted with arthritis, often have trouble opening the carton in this manner, though, because they can't hold the carton stably or aren't able to pull the gable apart with even force. The infirm and bedstricken have the same problems in trying to open these cartons on their own. When these cartons are not properly opened as intended, with stability and even force being applied, accidental spillage is often the result.

In order to avoid spilling of the contents, or as a courtesy, an attendant will sometimes open the cation for the patient. This solution, though, has the negative side effect of potentially adding to the loss of self esteem from the frustration over the inability to perform even this simple task for oneself. Separate straw hole pods have also been provided on some cartons on the slanted side of the cation. While providing an alternative option for opening the cation for drinking from a straw, the use of straw hole pods in this location have proven not to be sanitary because of their exposure during handling, and their use has, therefore, generally been abandoned.

Wherefore, there is a need for an improved drink cation for the elderly and the infirm which is easy for the patients to open and use by themselves, with lessened risk of accidental spillage and protection against unsanitary use.

SUMMARY OF THE INVENTION

The present invention provides a modification to the standard gabled drink carton which makes it easier for the elderly and the infirm patient to open and use the cation and to thereby drink nutritional liquid contained therein. More specifically, the present invention provides, in addition to the gabled pour spout on a standard gabled drink carton, a straw port which is located under the gable opposite thereto. Identifying markings are also provided to distinguish the pour-spout gable and the opposing straw-port gable, and to thereby help the user to locate the end which has the type of opening that is desired to be used.

Wherefore, it is an object of the present invention to provide a drink carton for the elderly and infirm which is easy to open and use. It is a further object to provide such a carton which helps to reduce the occurrence of accidental spillage and passively protects against unsanitary use.

DESCRIPTION OF THE PREFERRED EMBODIMENT

Figure 1:
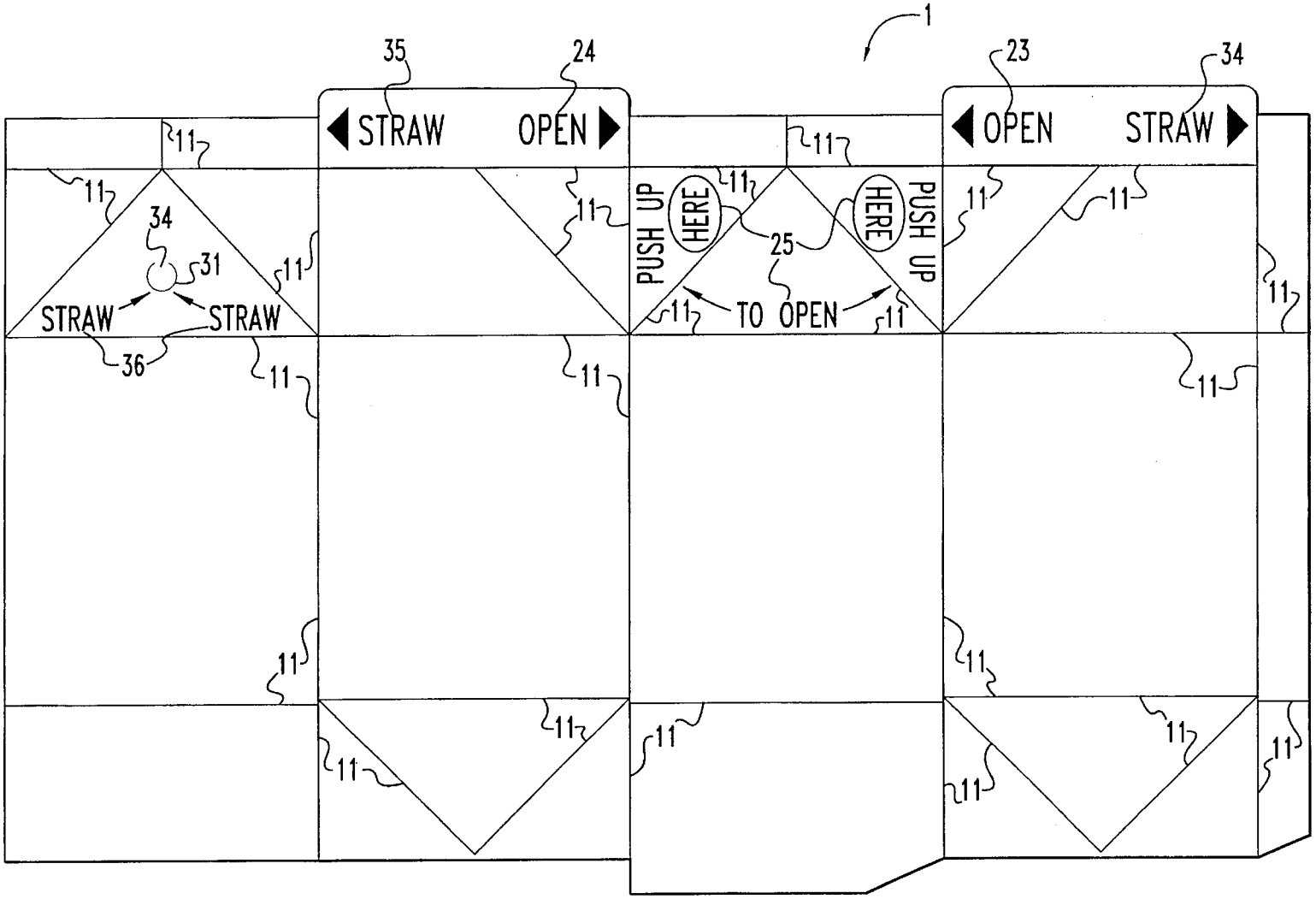
FIG. 1 is a top plan view of a cation blank of the present invention, prior to assembly into a drink cation.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the ad to which the invention relates.

Referring now specifically to the drawings, FIG. 1 is a view of the cation blank 1 of the present invention, prior to assembly into a drink cation. Cation blank 1 includes fold lines 11 for folding into a gabled drink cation, as is standardly known in the ad. Carton blank 1 also includes score line 31 which forms a straw port for opening thereof for drinking therethrough with a straw. Directional markings 23–25, and 34–36 have also been placed on cation blank 1 at various locations thereon to assist in the opening of the cation to be made by blank 1.

Figures 2, 3, 4, 5:
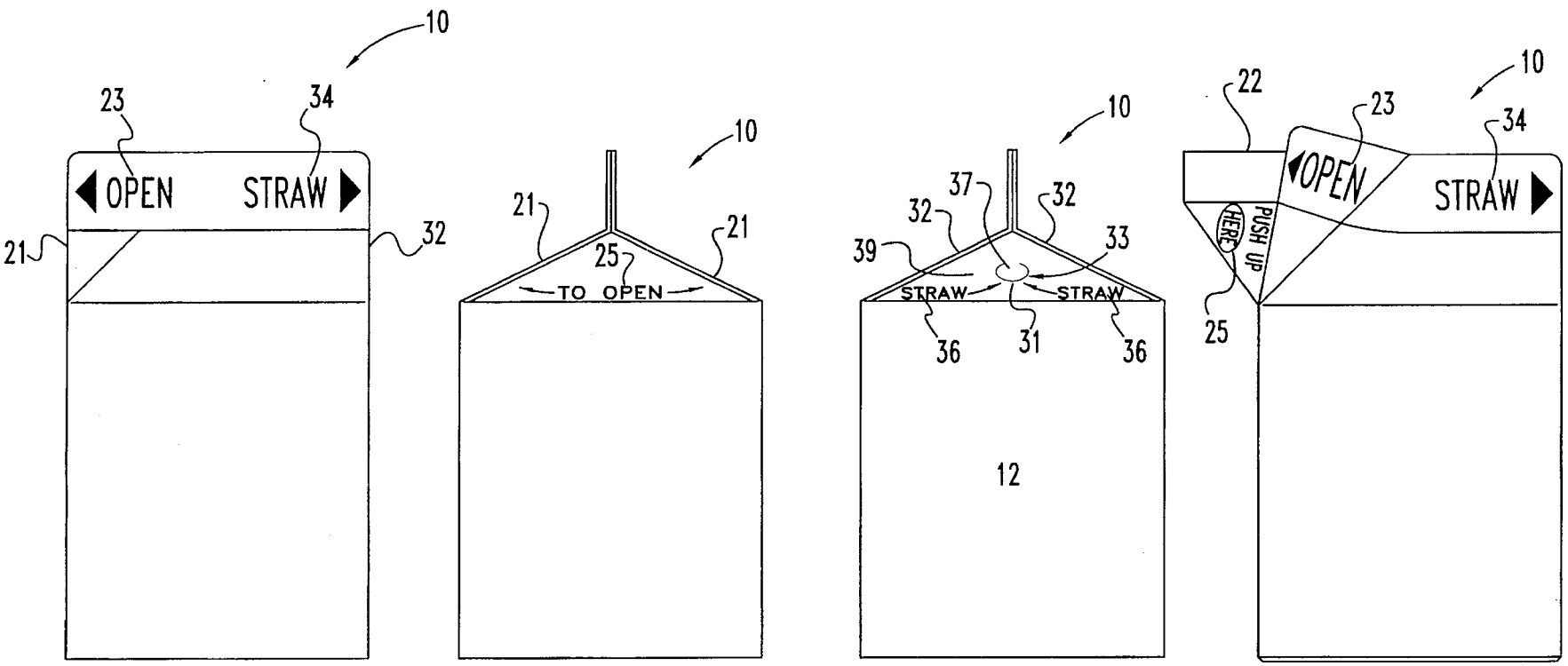
FIG. 2 is a side elevational view of the cation blank of FIG. 1 in assembled form.
FIGS. 3 and 4 are opposite end elevational views of the assembled carton of FIG. 2.
FIG. 5 is a side elevational view of the carton of FIGS. 2–4, with the pouring spout opened for drinking therefrom.
Figure 6:
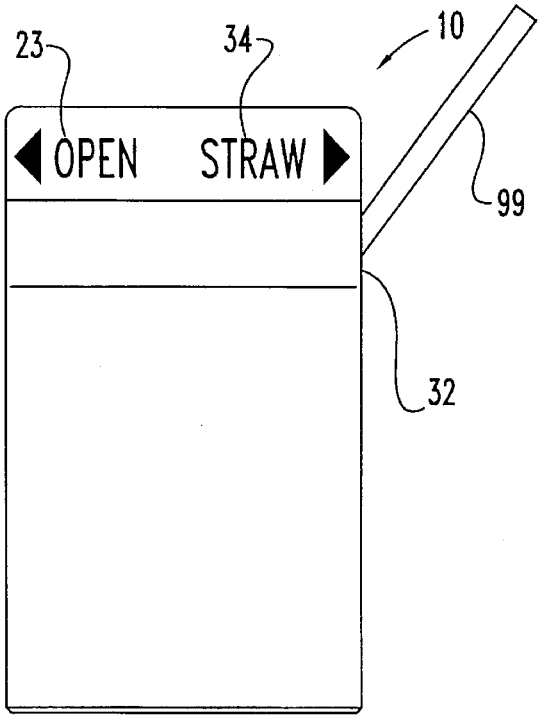
FIG. 6 is a side elevational view of the cation of FIGS. 2–4, with a straw inserted into the straw insertion hole under the opposing gable.
Figure 7:
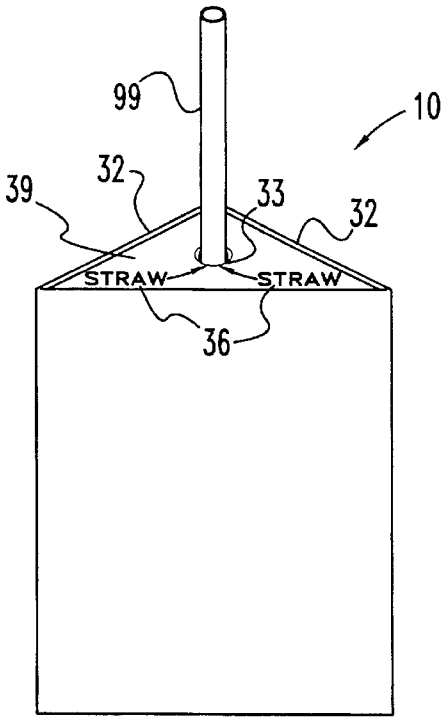
FIG. 7 is an end elevational view of the cation, as shown in FIG. 6, with a straw inserted into straw insertion hole for drinking therefrom.

FIGS. 2–7 are various views of cation blank 1 of FIG. 1 in assembled form. So assembled, cation blank 1 forms a gabled drinking cation 10 which is suitable for holding liquids and for drinking therefrom. At a first end of gabled drinking carton 10 is pour-spout gable 21 which is configured for opening into a spout 22, as shown in FIG. 5. At the opposite end opposing pour-spout gable 21 is a second straw-port gable 32. As shown in FIGS. 4 and 7, straw-pod gable 32 extends over and above sheltered surface portion 39 on which is located straw pod 33 that is formed by score line 31. As shown in FIGS. 2, 5, and 6, large lettered markings 23 and 34 serve to distinguish pour-spout gable 21 and straw-pod gable 32, thereby helping the person who is to open cation to properly orient the carton for opening. For the same purpose, corresponding markings 24 and 35, whose location on carton blank 1 is shown on FIG. 1, appear on the opposite side of assembled carton 10, which side is not shown in FIGS. 2–7. The large-lettered format is used to help those, particularly the elderly, who have poor or failing vision.

As shown in these drawings, as an alternative to using pour-spout 22, a person can drink from carton 10 by opening straw port 33 on sheltered surface portion 39, by placing straw 99 therethrough, and by then drinking though straw 99. FIG. 6 is a side elevational view of carton 10, showing straw 99 inserted into carton 10 under straw-port gable 32 for drinking from carton 10. FIG. 7 is an end elevational view of carton 10, as shown in FIG. 6, showing straw 99 inserted into straw port 33 on sheltered surface 39 for drinking from carton 99.

As shown and described above, straw port 33 is formed by score line 31 which forms an arc of about ⅞th of the circumference of a circle that is sized to loosely accommodate a standard straw. Straw port 33 can thus be opened by pushing against the central portion 37 within score line 31, by a straw for example, and to break away central portion 37 at score line 31 to thereby form a flap that pivots to open port 33 for receiving a straw therethrough. It is to be appreciated that other straw port 33 structures might alternatively be provided, such as by using a perforated line in lieu of a single score line, or by incorporating a removable cover flap which could be pulled away to expose a preformed hole thereunder.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A drinking cation for elderly and infirm persons, said drinking carton comprising:

a gabled carton, said gabled cation including means for holding liquid therein, said gabled carton further including a pour-spout gable, said pour-spout gable being openable into a pour-spout by which liquid contained in said carton can be poured therefrom, and a straw-pod gable oppositely disposed relative to said pour-spout gable on said gabled cation, said straw-port gable extending over and defining a sheltered surface portion of said gabled carton, and an openable straw port positioned in the sheltered surface portion of said gabled carton, said openable straw port being sufficiently openable with said straw-port gable remaining intact to receive an unbent drinking straw therethrough, whereby liquid can be withdrawn from said drinking carton by opening said straw-port with said straw-port gable intact, placing a drinking straw therethrough, and drinking through said drinking straw with said straw-port gable extending over and sheltering said straw-port.

2. The drinking carton of claim 1 additionally including identifying markings on said carton which distinguish said straw-port gable from said pour-spout gable.

3. The drinking carton of claim 1 wherein said straw port is opened by pressing on a scored piece of said carton and detaching said piece along a substantial portion of the perimeter of said scored piece.

4. The drinking carton of claim 1 wherein said straw port is substantially circular with a circumference slightly larger than the circumference of a drinking straw.

* * * * *

UNITED STATES PATENT AND TRADEMARK OFFICE
CERTIFICATE OF CORRECTION

PATENT NO. : 5,564,621

DATED : October 15, 1996

INVENTOR(S) : Writt

It is certified that error appears in the above-identified patent and that said Letters Patent is hereby corrected as shown below:

On title page of the patent, line 3 of the Abstract, please delete "cation" and insert in lieu thereof --carton--.

On title page of the patent, line 5 of the Abstract, please delete "cation" and insert in lieu thereof --carton--.

On title page of the patent, line 8 of the Abstract, please delete "pod" and insert in lieu thereof --port--.

In column 1, line 17, please delete "cation" and insert in lieu thereof --carton--.

In column 1, line 19, please delete "cation" and insert in lieu thereof --carton--.

In column 1, line 39, please delete "cation" and insert in lieu thereof --carton--.

In column 1, line 43, please delete "pods" and insert in lieu thereof --ports--.

Column 1, line 44, delete "cation" and insert --carton--.

In column 1, line 45, please delete "cation" and insert in lieu thereof --carton--.

In column 1, line 46, please delete "pods" and insert in lieu thereof --ports--.

In column 1, line 50, please delete "cation" and insert in lieu thereof --carton--.

In column 1, line 59, please delete "cation" and insert in lieu thereof --carton--.

In column 2, line 9, please delete "cation" and insert in lieu thereof --carton--.

UNITED STATES PATENT AND TRADEMARK OFFICE

CERTIFICATE OF CORRECTION

PATENT NO. : 5,564,621

DATED : October 15, 1996

INVENTOR(S) : Writt

It is certified that error appears in the above-identified patent and that said Letters Patent is hereby corrected as shown below:

In column 2, line 10, please delete "cation" and insert in lieu thereof --carton--.

In column 2, line 11, please delete "cation" and insert in lieu thereof --carton--.

In column 2, line 18, please delete "cation" and insert in lieu thereof --carton--.

In column 2, line 21, please delete "cation" and insert in lieu thereof --carton--.

In column 2, line 37, please delete "ad" and insert in lieu thereof --art--.

In column 2, line 39, please delete "cation" and insert in lieu thereof --carton--.

Column 2, line 40, delete "cation" and insert --carton--.

In column 2, line 40, please delete "Cation" and insert in lieu thereof --Carton--.

In column 2, line 41, please delete "cation" and insert in lieu thereof --carton--.

In column 2, line 42, please delete "ad" and insert in lieu thereof --art--.

In column 2, line 45, please delete "cation" and insert in lieu thereof --carton--.

In column 2, line 47, please delete "cation" and insert in lieu thereof --carton--.

Column 2, line 48, delete "cation" and insert --carton--.

In column 2, line 49, please delete "cation" and insert in lieu thereof --carton--.

UNITED STATES PATENT AND TRADEMARK OFFICE

CERTIFICATE OF CORRECTION

PATENT NO. : 5,564,621

DATED : October 15, 1996

INVENTOR(S) : Writt

It is certified that error appears in the above-identified patent and that said Letters Patent is hereby corrected as shown below:

In column 2, line 50, please delete "cation" and insert in lieu thereof --carton--.

In column 2, line 55, please delete "pod" and insert in lieu thereof --port--.

In column 2, line 57, please delete "pod" and insert in lieu thereof --port--.

In column 2, line 60, please delete "pod" and insert in lieu thereof --port--.

In column 2, line 61, please delete "cation" and insert in lieu thereof --carton--.

In column 3, line 32, please delete "cation" and insert in lieu thereof --carton--.

In column 4, line 1, please delete "cation" and insert in lieu thereof --carton--.

In column 4, line 8, please delete "pod" and insert in lieu thereof --port--.

UNITED STATES PATENT AND TRADEMARK OFFICE

CERTIFICATE OF CORRECTION

PATENT NO. : 5,564,621

DATED : October 15, 1996

INVENTOR(S) : Writt

It is certified that error appears in the above-identified patent and that said Letters Patent is hereby corrected as shown below:

Column 4, line 9, delete "cation" and insert in lieu thereof --carton--.

Signed and Sealed this

Twenty-fifth Day of March, 1997

*Attest:*

Bruce Lehman

BRUCE LEHMAN

*Attesting Officer*

*Commissioner of Patents and Trademarks*